US008407869B2

(12) United States Patent
Imaizumi

(10) Patent No.: US 8,407,869 B2
(45) Date of Patent: Apr. 2, 2013

(54) CARPET HAVING A RASCHEL FABRIC ON THE BACK FACE

(75) Inventor: Masahiko Imaizumi, Aichi (JP)

(73) Assignee: Fukui Fibertech Co., Ltd., Aichi (JP)

( * ) Notice: Subject to any disclaimer, the term of this patent is extended or adjusted under 35 U.S.C. 154(b) by 0 days.

(21) Appl. No.: 13/152,085

(22) Filed: Jun. 2, 2011

(65) Prior Publication Data

US 2011/0225782 A1 Sep. 22, 2011

Related U.S. Application Data

(62) Division of application No. 10/570,841, filed as application No. PCT/JP2004/013204 on Sep. 10, 2004.

(30) Foreign Application Priority Data

Sep. 10, 2003 (JP) ..... 2003-317772

(51) Int. Cl.
*D06C 13/08* (2006.01)
*B32B 38/00* (2006.01)

(52) U.S. Cl. ..... 26/8 R; 156/72; 156/250; 28/107

(58) Field of Classification Search ..... 428/95, 428/92; 442/312, 313, 314; 26/8 R, 7; 66/169 R, 66/190, 191, 194; 112/107, 112, 165; 156/72, 156/78, 250
See application file for complete search history.

(56) References Cited

U.S. PATENT DOCUMENTS 3,817,817 A 6/1974 Pickens, Jr. et al.
3,922,454 A 11/1975 Roecker
4,338,800 A 7/1982 Matsuda
4,376,146 A 3/1983 Juhasz et al.
(Continued)

FOREIGN PATENT DOCUMENTS

AT 200001785 A * 12/2005
JP 55-148503 A 11/1980
(Continued)

OTHER PUBLICATIONS

International Search Report for Ineternational Application No. PCT/JP2004/013204, dated Dec. 21, 2004, 2 pages.
(Continued)

*Primary Examiner* — Cheryl Juska
(74) *Attorney, Agent, or Firm* — Brinks Hofer Gilson & Lione

(57) ABSTRACT

A carpet is having a raschel fabric to the back face. The raschel fabric consists of wefts which are inlay-yarns and warps which are chain-stitched yarns. The warp consists of chain-stitched ground yarns 3*a*, 3*b*, and a pile yarn 4 which forms standing loop piles on specified courses and which is chain-stitched with the ground yarns except said specified courses. The pile yarn consists of two mono-filaments 5, 5. The two mono-filaments 5, 5 are twisted at least one time per the length of each loop pile. Cut piles are formed by mechanically cutting the each loop pile near the top thereof. The two mono-filaments in the cut pile are disjoining each other and standing with inclination at random direction on the raschel fabric. When the carpet is placed on the surface of a mat, each mono-filament which is formed on the back face of the carpet, bites into the surface of the mat. Therefore, it is prevented that the carpet is displaced.

4 Claims, 4 Drawing Sheets

U.S. PATENT DOCUMENTS

| | | | | |
|---|---|---|---|---|
| 4,463,486 | A | 8/1984 | Matsuda | |
| 4,522,857 | A * | 6/1985 | Higgins | 428/95 |
| 5,380,574 | A | 1/1995 | Katoh et al. | |
| 5,481,786 | A * | 1/1996 | Smith et al. | 28/107 |
| 5,545,276 | A * | 8/1996 | Higgins | 156/79 |
| 6,594,874 | B1 * | 7/2003 | Fleissner | 28/159 |
| 6,699,560 | B1 | 3/2004 | Schulte | |
| 7,341,773 | B1 | 3/2008 | Schulte | |

FOREIGN PATENT DOCUMENTS

| | | | |
|---|---|---|---|
| JP | 03-060483 | B | 9/1991 |
| JP | 06-228848 | A | 8/1994 |
| JP | 08-291447 | A | 11/1996 |

OTHER PUBLICATIONS

Office Action from co-pending U.S. Appl. No. 10/570,841, dated Sep. 24, 2008, 8 pages.

Office Action from co-pending U.S. Appl. No. 10/570,841, dated Apr. 9, 2009, 6 pages.

Office Action from co-pending U.S. Appl. No. 10/570,841, dated Mar. 25, 2010, 8 pages.

Office Action from co-pending U.S. Appl. No. 10/570,841, dated Dec. 6, 2010, 5 pages.

* cited by examiner

CARPET HAVING A RASCHEL FABRIC ON THE BACK FACE

RELATED APPLICATIONS

This application is a divisional application of U.S. patent application Ser. No. 10/570,841 filed on Dec. 4, 2006, which is a 371 application of PCT/JP2004/013204 having an international filing date of Sep. 10, 2004, which claims priority to JP2003-317772 filed on Sep. 10, 2003, the entire contents of which are incorporated herein by reference.

TECHNICAL FIELD

The present invention relates to various carpets, such as floor mats for automobiles, indoor carpets, heated carpets for an electric heater, door carpet for removing soil from shoes, or kitchen carpet. Especially, the invention relates to a carpet having a raschel fabric on the back face, the function of which is to prevent the carpet from being easily displaced.

BACKGROUND ART

A mat is placed on the entire floor of an automobile or a room. A small carpet may be placed on top of the mat. In the invention, "carpet" refers to the small carpet placed on top of the mat.

Previously, depending on the surface of the mat, the carpet was easily moved since the carpet was only resting on the surface of the mat. Since the coefficient of friction between the back face of the carpet and the surface of the mat was low, the carpet was easily displaced on the surface of the mat. Therefore, a specially treated raschel fabric was attached on the back face of the carpet, which prevented the carpet from being displaced by providing the carpet with a non-slip surface. For example, multiple standing loop piles were formed on the raschel fabric and provided on the back face of the carpet. In this case, the loop piles provided on the back face of the carpet engaged with the surface of the mat prevented the carpet from being displaced. The loop piles formed on the raschel fabric, which engaged with the mat, were generally inclined in the direction of the knitting, and therefore while the carpet was not displaced in the inclining direction, the carpet was easily displaced in the opposite direction of the inclining direction. Moreover, it was difficult for the loop piles to engage with the surface of the mat, because the top of each loop pile became round.

Therefore, it was necessary to heat and melt a ¼ length or more of each loop pile from the top thereof. The tops were melted and cut, thus changing the loop piles to cut piles. The molten balls were formed at the cutting ends of the cut pile. Moreover, the loop piles were pressed during the heating and melting process so that the molten balls became inclined in random directions (patent reference 1). When the cut piles having the molten balls were formed on the back face of the carpet, the carpet was prevented from being displaced on the mat because the cut piles having the molten balls engaged with the surface of the mat. Moreover, the carpet was prevented from becoming displaced in all directions since the cut piles were inclined in random directions.

Patent reference 1: JP3-60483B (page 2, from lines 37 of columns 3 to line 3 of columns 4, page 2, from line 41 to line 43 of columns 4, and drawing of pages 4)

SUMMARY OF THE INVENTION

Problem to be Solved by the Invention

In the technique described in Patent reference 1, the loop piles had to be pressed while heated and melted to incline the cut piles in random directions. Since the heat source was drawn toward the raschel fabric, there was a danger that the raschel fabric would be burned.

The invention avoids using the above referenced technique to produce the randomly inclined cut piles. According to this invention, it is possible to naturally create the randomly inclined cut piles when the tops of each loop piles are mechanically cut. The object of the present invention to form cut piles which are randomly inclined on the raschel fabric, using a simple process.

Means for Solving the Problem

The invention relates to a carpet, the back face of which being comprised of a raschel fabric. The raschel fabric comprises wefts, which are made of inlay-yarns, and warps, each of which contains at least one chain-stitched ground yarn and at least one pile yarn. The pile yarn forms standing loop piles on specified courses, and is chain-stitched with said ground yarn, except for in said specified courses. The pile yarn comprises at least two mono-filaments which are twisted at least one time per the length of each loop pile. The each loop pile is mechanically cut near the top thereof, and is changed into cut piles. Each of the cut piles is comprised of the mono-filaments which are disjoined from each other and standing in randomly inclined directions on the raschel fabric.

In the carpet according to the invention, the raschel fabric 1 and the body 11 of the carpet may be layered together in this order from the surface. Moreover, in the carpet according to the invention, the raschel fabric 1, a layer of foamed material 12 and the body 11 of the carpet may be layered together in this order from the surface (FIG. 1). A conventional material, for example, a woven fabric, a knitted fabric or a nonwoven fabric etc., may be used for the body 11 of the carpet. The body 11 of the carpet and the raschel fabric 1 may be layered together, using any conventional method. For example, they may be layered together by means of an adhesive agent. In the case that the body 11 is made of nonwoven fabric, they may be layered together by interlacing fibers in the nonwoven fabric to the wefts and/or warps in the raschel fabric 1, using a needle punching machine. In this case, the nonwoven fabric may be made at least partially of fibers having low melting point. Alternatively, it may be preferable to use sheath-core type conjugate fibers, each of which has the sheath component of a low melting point component and the core component of a high melting point component, may be entirely or partially used. By so constructing the nonwoven fabric, the fibers having low melting points or the sheath component of the conjugate fibers may be melted and solidified, whereby the fibers and the wefts and/or warps can be melt-bonded, and therefore the nonwoven fabric of the body 11 and the raschel fabric 1 can be more strongly layered together. Furthermore, in the carpet shown in FIG. 1, the body 11 of the carpet and the foamed material 12 are layered together by means of adherence realized by an adhesive agent, for example. If the body 11 is made of nonwoven fabric, they may be layered together by interlacing the fibers in the nonwoven fabric to the layer of foamed material 12, using a needle punching machine. The raschel fabric 1 attached to the back face of the layer of foamed material 12 constitutes the back face of the carpet.

The raschel fabric 1 used in the present invention is a conventional raschel fabric and consists of wefts which are inlay-yarns and warps which are chain-stitched yarns. The warp 2 consists of a ground yarn 3 and a pile yarn 4. The ground yarn 3 may be made of, a conventional yarn such as a mono-filament, a multi-filament or a spun yarn etc. It may be preferable to use the mono-filament for the ground yarn because the mono-filament is also used for the pile yarn. The mono-filament may be a polyethylene mono-filament, a polypropylene mono-filament or polyamide (nylon) mono-filament etc. The fineness of the mono-filament may be 100 deniers or more, preferably about 300 deniers.

FIG. 2 shows only the warps 2 in the raschel fabric, and the wefts of the inlay-yarns are omitted from the figure. In FIG. 2, two strands of the ground yarn 3*a* and 3*b* are used as the ground yarn 3. That is, the warp 2 is formed by chain-stitching the two yarns left and right symmetrically with two guide bars. The directivity of the chain-stitched warp 2 is smaller because it is chain-stitched left and right symmetrically. It is preferable because the loop piles easily stand upward from the ground yarn 3*a* and 3*b*.

The pile yarn 4 is chain-stitched in the same manner as the ground yarn. However, the standing loop piles are formed at specified course intervals. For example, the pile yarn is chain-stitched through four courses and looped on the next course as showing in FIG. 2. The pile yarn is gain chain-stitched through the next four courses and looped on the following course. The pile yarn is thereafter knitted, using the above mentioned method. Accordingly, one standing loop pile is formed at every four courses. Each of the warps 4 similarly has the loop piles. It is preferable to have the loop piles in a zigzag pattern without having the loop piles at the same course on adjacent warps 2, 2 . . . . The zigzag pattern allows the cut piles from the loop piles to engage with the entire surface of the mat.

FIG. 3 is a schematic figure which shows the pile yarn 4, and the ground yarn 3*a* and 3*b* separately. As showing in FIG. 3, the warp 2 according to one embodiment consists of one pile yarn 4 and two ground yarns 3, that is, consisting of three yarns total in this embodiment of the invention. However, the warp 2 also may consist of at least one pile yarn and at least one ground yarn. Additionally, the warp may consist of two pile yarns and two ground yarns, that is, consisting of four yarns at total. The warp may also consist of five or more yarns at total.

The invention is characterized by the pile yarn 4 being composed of at least two mono-filaments. The mono-filament may be, for example, a polyethylene mono-filament, a polypropylene mono-filament or polyamide (nylon) mono-filament etc. The fineness of the mono-filament may be 100 deniers or more, preferably about 300 deniers. At least two mono-filaments are twisted, and the number of twisting is more than a designated number. The designated twisting number is more than one along the length of the loop pile. Because each mono-filament is twisted one or more times along the length of the loop pile, when cut, in near the top of the loop pile the twisting is loosened and the cut ends extend in random directions. Accordingly, the cut piles stand at inclinations in random directions. The rigidity of each mono-filament 5, 5 . . . contributes to the loosening of the twisting. Therefore, it is preferable that the fineness of each mono-filament 5, 5 . . . is thicker, that is, 100 deniers or more as above mentioned.

The inlay-yarn which is the weft in the raschel fabric according to the present invention may be a conventional yarn. It is preferable to use a spun yarn as the inlay-yarn. This is because the back face of the foamed material 12 is partially impregnated into the fibers of the spun yarn, as is the case in FIG. 1 in which the raschel fabric 1 may be layered together with the foamed material 12 during the production process. Furthermore, in the case where the body 11 of the carpet is made of nonwoven fabric and the raschel fabric 1 is layered together with the nonwoven fabric, using a the needle punching machine, the fibers of the spun yarn may be preferably interlaced with the fibers in the nonwoven fabric.

The carpet of the invention may be produced, for example, by the following method. The body 11 of the carpet is adhered to the surface of the raschel fabric with an adhesive agent etc, which is opposite to the surface of the raschel fabric on which the loop piles are formed. As the result, a laminated material in which the raschel fabric 1 and the body 11 of the carpet are layered together is obtained. In the case where the body 11 of the carpet is made of nonwoven fabric, after the body 11 and the raschel fabric 1 are layered together, the fibers in the nonwoven fabric may be interlaced with the wefts and/or the warps, using a needle punching machine to thereby obtain a laminating material in which the raschel fabric 1 and the body 11 are layered together. Furthermore, after a foamable resin and the body 11 of the carpet are laminated on the surface of the raschel fabric on which the loop piles are not formed as shown in FIG. 2, the foamable resin is foamed to become a foamed material 12, whereby due to the adhesiveness of the foamable resin, the body 11 of the carpet, the layer of the foamed material 12 and the raschel fabric 1 are layered together to thereby obtain a laminated material. Moreover, after the foamed material 12 and the body 11 of the carpet are layered together, using an adhesive agent or a needle punching machine, the surface of the foamed material 12 is adhered by the adhesive agent etc. to the surface of the raschel fabric 1 on which the loop piles are not formed, whereby the body 11 of the carpet, the layer of the foamed material 12 and the raschel fabric 1 are layered together to obtaina laminated material. Thereafter, each of the loop piles which are formed on the back surface of the raschel fabric is cut, using a knife, near the top thereof to obtain the carpet according to the invention. Alternately, when the raschel fabric is knitted, simultaneously with or after forming the loop piles, each loop pile is cut near the top to form the raschel fabric having the cut piles as shown by FIG. 4. The surface of the resulting raschel fabric on which the cut piles are not formed resulting raschel fabric is layered together with the body 11 of the carpet, or after the foamable material is laminated to the surface of the raschel fabric on which the cut piles are not formed, and the body 11 of the carpet is laminated to the surface of the foamable material, the foamable material is foamed to become a foamed material and thereafter, the two-layer material consisting of the layer of the foamed material 12 and the body 11 of the carpet which are layered together is adhered by the adhesive agent to the surface of the raschel fabric on which the cut piles are not formed. As the result, the carpet of the invention is obtained in which the body 11 of the carpet, the layer of the foamed material 12 and the raschel fabric 1 (the cut piles have been formed on the back surface of the raschel fabric 1) are layered together. The cut ends of the cut piles may be left untreated, or may be treated to have molten balls by melting the cut ends, using a singeing machine or a heater etc. The molten balls prevent the carpet from being displaced.

The carpet of the invention may be used as a small carpet. The carpet may be placed on a mat which is placed on the entire floor. However, the carpet of the invention may be placed on the floor without the mat.

Effect of the Invention

The invention adopts the specific pile yarn with the pile loops formed on the raschel fabric adhered to the back side of the carpet. That is, the pile yarn consists of at least two mono-filaments, and is twisted one or more times along the length of the loop pile. Accordingly, when the loop pile is mechanically cut near the top thereof, the mono-filaments twisted at least one time are loosened, and the cut ends extend in random directions. Therefore, each of the cut piles having the cutting ends extend at an inclination in a random direction. That is, by using the invention, the cut piles which extend at inclinations in random directions are obtained by cutting each of the loop piles. When the carpet is placed on the mat etc., the carpet is prevented from being displaced in all directions.

As explained above, the invention produces a carpet which is non-slip in all directions.

DESCRIPTION OF NUMERAL OF DRAWINGS

Numeral 1 is a raschel fabric.
Numeral 2 is a warp.
Numeral 3, 3*a*, 3*b* are ground yarns.
Numeral 4 is a pile yarn.
Numeral 5 is a mono-filament composing the pile yarn.

DETAILED DESCRIPTION OF THE PREFERRED EMBODIMENTS

EXAMPLE 1

Figure 1:
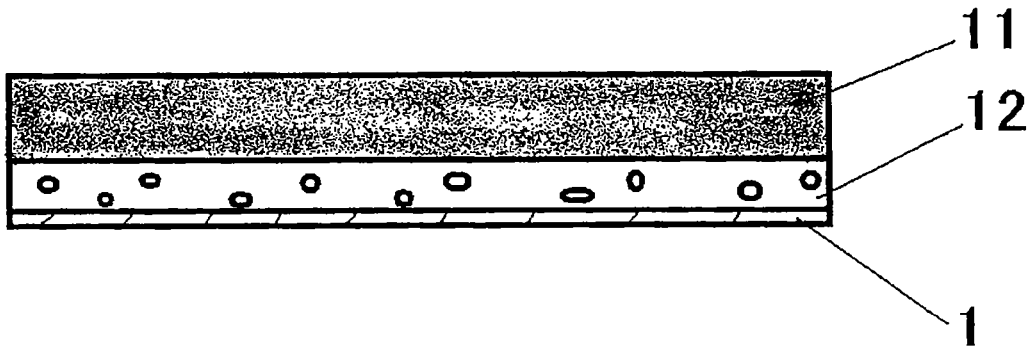
FIG. 1 is a side view of a carpet, on the back face of which a raschel fabric is adhered.
Figure 2:
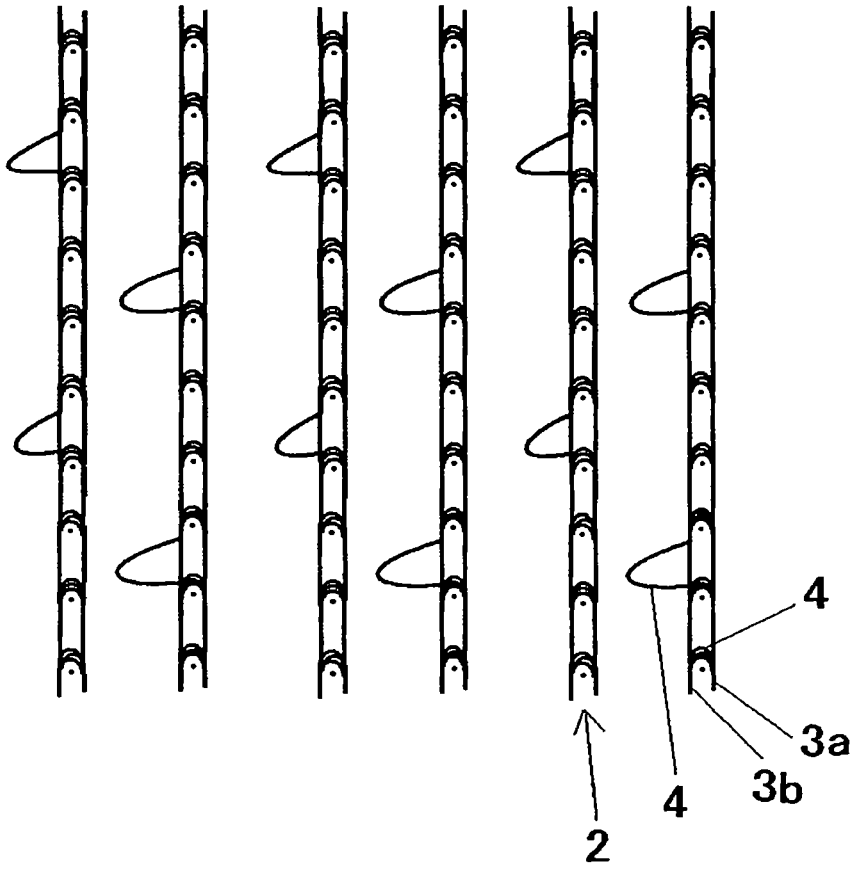
FIG. 2 is a view of a knitting design of a raschel fabric.

Two polyethylene mono-filaments, each of which was 300 deniers, were prepared as a ground yarn. One pile yarn in which two polyethylene mono-filaments were twisted at 180 times per meter was prepared. The polyethylene mono-filament was 300 deniers. An inlay-yarn of a weft which was a spun yarn was prepared. The spun yarn was yarn number count 3.5 and consisted of a mixture of polyester fibers and acrylic fibers. Using the ground yarns, the pile yarns, and the inlay-yarn, the raschel fabric consisting of warps and wefts was knitted using the knitting design as shown in FIG. 2 (FIG. 3) and loop piles were formed at every 4 courses. The count of knitting gauges was 2 gauges per inch and the count of courses was 10 courses per inch. The length of the loop pile was 10 mm. The loop piles were provided with a zigzag pattern with respect to adjacent warps. After that, each loop pile was cut near the top with a knife, and thereby cut piles were formed. As a result, the cut piles stood at inclinations in random directions. After that, cut ends of the cut piles were heated with a heater; molten balls were formed at the cut end. As result, the raschel fabric having cut piles was obtained.

EXAMPLE 2

Figure 3:
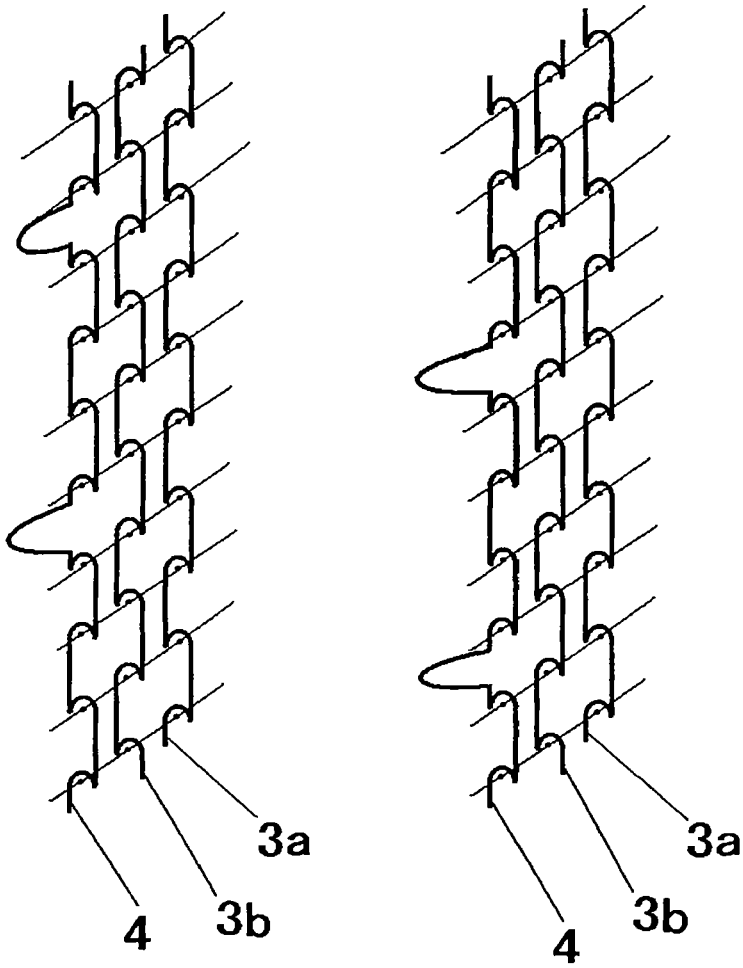
FIG. 3 is a view of each mono-filament, which composes each warp in the FIG. 2.
Figure 4:
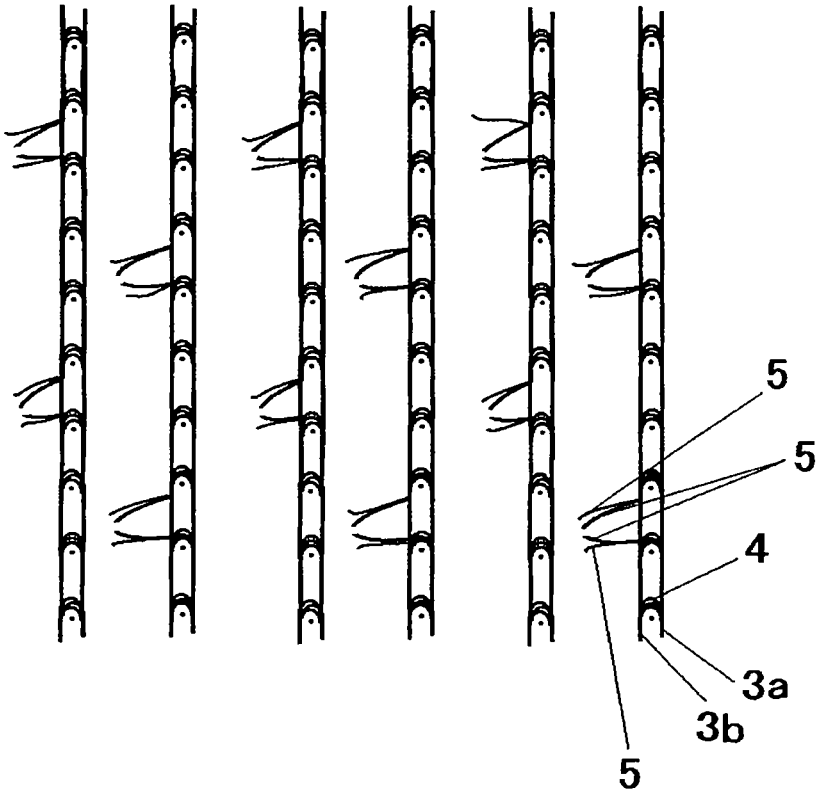
FIG. 4 is a view of cut piles, which are formed by cutting each loop pile on the raschel fabric near the top as shown in the FIG. 2

Two pile yarns in which two polyethylene mono-filaments were twisted at 180 times per meter were prepared. The polyethylene mono-filament was 300 deniers. One pile yarn was added in the knitting design as shown in FIG. 2 (FIG. 3). The raschel fabric was obtained by using the same method as in example 1.

EXAMPLE 3

An inlay-yarn which was a polypropylene multi-filament of 2400 deniers/192 filaments was prepared. Using the inlay-yarn, the raschel fabric was obtained by using the same method as in example 1.

EXAMPLE 4

Polyurethane resin was applied to the back surface of the body of the carpet. Each raschel fabric of the above Examples was laminated to the layer of the polyurethane resin. The surface of the raschel fabric on which cut piles were not formed was applied with the layer of the polyurethane resin. After that, the layer of the polyurethane resin was foamed by heating, and three carpets were obtained. three carpets were obtained in each of which the body of the carpet, the layer of foamed polyurethane resin, and the raschel fabric were layered together. When each carpet was placed on the mat, the cut piles on the back surface of the carpet engage with the surface of the mat, and the mat was prevented from being displaced in all directions.

What is claimed is:

1. A method of making a carpet a back surface of which is formed of a raschel fabric, the method comprising:

providing wefts made of inlay-yarns and warps made of chain-stitched yarns, each warp comprising at least one chain-stitched ground yarn and at least one pile yarn, the at least one pile yarn comprising at least two mono-filaments twisted together substantially uniformly along their length;

knitting the wefts and the warps to make the raschel fabric in such a manner that at least one pile yarn is chain-stitched around the at least one ground yarn and forms a loop pile standing from one surface of the raschel fabric at every two or more courses along the respective warps so as to avoid having two loop piles in a same course on two adjacent warps, the at least two mono-filaments being twisted together at least one time along each of the loop piles; and performing one of following steps (a) and (b) before performing the other:

(a) fixing the raschel fabric to the carpet so that a surface of the raschel fabric opposite to the one surface thereof from which the loop piles stand faces the back surface of the carpet; and (b) cutting each loop pile near the top thereof to form cut piles so that in each of the cut piles, the at least two mono-filaments are at least partially untwisted and extend in randomly inclined directions from the raschel fabric.

2. The method according to claim 1, wherein fixing the raschel fabric to the carpet comprise adhering the raschel fabric to the carpet.

3. The method according to claim 1, wherein fixing the raschel fabric to the carpet comprise needle-punching a laminate of the raschel fabric and the carpet together.

4. The method according to claim 1, further comprising applying a layer of a foamed material to one of the raschel fabric and the carpet before fixing them.

* * * * *